US008668443B2

(12) United States Patent
Espasa et al.

(10) Patent No.: US 8,668,443 B2
(45) Date of Patent: Mar. 11, 2014

(54) VARIABLE-VANE ASSEMBLY HAVING UNISON RING GUIDED RADIALLY BY ROLLERS AND FIXED MEMBERS, AND RESTRAINED AXIALLY BY ONE OR MORE FIXED AXIAL STOPS

(75) Inventors: Olivier Espasa, Morristown, NJ (US); Pierre Barthelet, Morristown, NJ (US); Julien Mailfert, Morristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 1099 days.

(21) Appl. No.: 12/684,268

(22) Filed: Jan. 8, 2010

(65) Prior Publication Data

US 2011/0171009 A1 Jul. 14, 2011

(51) Int. Cl.
*F04D 29/56* (2006.01)

(52) U.S. Cl.
USPC ..... 415/160; 415/165

(58) Field of Classification Search
USPC ..... 415/148, 155, 159, 160, 162, 163, 164, 415/165
See application file for complete search history.

(56) References Cited

U.S. PATENT DOCUMENTS

| | | | | |
|---|---|---|---|---|
| 5,308,226 | A * | 5/1994 | Venkatasubbu et al. | 415/160 |
| 6,269,642 | B1 * | 8/2001 | Arnold et al. | 60/602 |
| 7,670,107 | B2 * | 3/2010 | Barthelet et al. | 415/160 |
| 2004/0047727 | A1 * | 3/2004 | Vogiatzis | 415/163 |
| 2004/0170495 | A1 * | 9/2004 | Vogiatzis | 415/163 |
| 2008/0075582 | A1 * | 3/2008 | Sausse et al. | 415/159 |
| 2008/0240906 | A1 * | 10/2008 | Barthelet et al. | 415/148 |
| 2009/0092483 | A1 * | 4/2009 | Yasui et al. | 415/159 |
| 2010/0260597 | A1 * | 10/2010 | Sausse et al. | 415/160 |

FOREIGN PATENT DOCUMENTS

| | | | |
|---|---|---|---|
| DE | 19731715 | A1 | 1/1998 |
| DE | 102004023209 | A1 | 12/2005 |
| DE | 102007056154 | A1 | 5/2009 |
| JP | 2002068963 | A | 2/2002 |
| WO | WO-03/036062 | A1 | 5/2003 |
| WO | WO-2008/118833 | A1 | 10/2008 |
| WO | WO-2009/102546 | A1 | 8/2009 |

OTHER PUBLICATIONS

Office Action for European Application No. 10196275.1; dated Feb. 13, 2013.
Search Report for European Application No. 10196275.1; dated Jan. 31, 2013.

* cited by examiner

*Primary Examiner* — Edward Look
*Assistant Examiner* — Aaron R Eastman
(74) *Attorney, Agent, or Firm* — Alston & Bird LLP

(57) ABSTRACT

A variable-vane assembly for a variable nozzle turbine comprises a nozzle ring supporting a plurality of vanes affixed to vane arms that are engaged in recesses in the inner edge of a unison ring. The unison ring is rotatable about the axis of the nozzle ring so as to pivot the vane arms, thereby pivoting the vanes in unison. The unison ring is radially restrained by a combination of radial guide rollers and fixed axial-radial guide pins secured to the nozzle ring, and is axially restrained by one or more axial stops affixed to the nozzle ring.

2 Claims, 6 Drawing Sheets

VARIABLE-VANE ASSEMBLY HAVING UNISON RING GUIDED RADIALLY BY ROLLERS AND FIXED MEMBERS, AND RESTRAINED AXIALLY BY ONE OR MORE FIXED AXIAL STOPS

BACKGROUND OF THE INVENTION

The present invention relates to turbochargers having a variable-nozzle turbine in which an array of movable vanes is disposed in the nozzle of the turbine for regulating exhaust gas flow into the turbine.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

One of the challenges in boosting engine performance with a turbocharger is achieving a desired amount of engine power output throughout the entire operating range of the engine. It has been found that this objective is often not readily attainable with a fixed-geometry turbocharger, and hence variable-geometry turbochargers have been developed with the objective of providing a greater degree of control over the amount of boost provided by the turbocharger. One type of variable-geometry turbocharger is the variable-nozzle turbocharger (VNT), which includes an array of variable vanes in the turbine nozzle. The vanes are pivotally mounted in the nozzle and are connected to a mechanism that enables the setting angles of the vanes to be varied. Changing the setting angles of the vanes has the effect of changing the effective flow area in the turbine nozzle, and thus the flow of exhaust gas to the turbine wheel can be regulated by controlling the vane positions. In this manner, the power output of the turbine can be regulated, which allows engine power output to be controlled to a greater extent than is generally possible with a fixed-geometry turbocharger.

Typically the variable-vane assembly includes a nozzle ring that rotatably supports the vanes adjacent one face of the nozzle ring. The vanes have axles that extend through bearing apertures in the nozzle ring, and vane arms are rigidly affixed to the ends of the axles projecting beyond the opposite face of the nozzle ring. Thus the vanes can be pivoted about the axes defined by the axles by pivoting the vane arms so as to change the setting angle of the vanes. In order to pivot the vanes in unison, an actuator ring or "unison ring" is disposed adjacent the opposite face of the nozzle ring and includes recesses in its radially inner edge for receiving free ends of the vane arms.

Accordingly, rotation of the unison ring about the axis of the nozzle ring causes the vane arms to pivot and thus the vanes to change setting angle.

The variable-vane assembly thus is relatively complicated and presents a challenge in terms of assembly of the turbocharger. There is also a challenge in terms of how the unison ring is supported in the assembly such that it is restrained against excessive radial and axial movement while being free to rotate for adjusting the vane setting angle. Various schemes have been attempted for supporting unison rings, including the use of rotatable guide rollers supported by the nozzle ring. Such guide rollers complicate the assembly of the variable-vane assembly because by their very nature they can easily fall out of or otherwise become separated from the nozzle ring, since typically they fit loosely into apertures in the nozzle ring.

BRIEF SUMMARY OF THE DISCLOSURE

The present disclosure relates to a variable-vane assembly for a variable nozzle turbine such as used in a turbocharger, in which the unison ring is radially located by guide rollers secured to the nozzle ring (or by a combination of guide rollers and axial-radial guide pins) and is axially restrained by one or more fixed axial stops secured to the nozzle ring.

In one embodiment, the assembly comprises a nozzle ring encircling an axis and having an axial thickness defined between opposite first and second faces of the nozzle ring, the nozzle ring having a plurality of circumferentially spaced-apart first apertures each extending axially into the first face and a plurality of circumferentially spaced-apart second apertures that are circumferentially spaced from the first apertures and each of which extends axially from the first face to the second face. There are a plurality of vanes each having an axle extending from one end thereof, the axles being received respectively into the second apertures from the second face of the nozzle ring and being rotatable in the second apertures such that the vanes are rotatable about respective axes defined by the axles, a distal end of each axle projecting out from the respective second aperture beyond the first face. A plurality of vane arms are respectively affixed rigidly to the distal ends of the axles, each vane arm having a free end. A unison ring is itioned coaxially with the nozzle ring adjacent the first face thereof, the unison ring having a first side that faces the first face of the nozzle ring and having an opposite second side. The unison ring has a radially inner edge defining a plurality of recesses therein respectively receiving the free ends of the vane arms, the unison ring being rotatable about the axis of the nozzle ring so as to pivot the vane arms, thereby pivoting the vanes in unison.

A plurality of radial guide rollers are provided for the unison ring. The radial guide rollers each is supported on a pin that is received in a respective one of the first apertures in the nozzle ring and is rigidly affixed therein, such that the radial guide rollers are secured to the nozzle ring and positioned such that the radially inner edge of the unison ring is restrained by the radial guide rollers against excessive movement in radial directions.

The assembly further comprises a fixed axial stop for the unison ring, the axial stop having an affixing portion that is received in another of the first apertures in the nozzle ring and is rigidly affixed therein, and a stop portion projecting out from the first aperture. A part of the stop portion overhangs and opposes the second side of the unison ring so as to prevent excessive axial movement of the unison ring away from the nozzle ring.

The variable-vane assembly in one embodiment further comprises a axial-radial guide pin inserted into yet another first aperture of the nozzle ring and rigidly affixed therein such that the axial-radial guide pin is non-rotatably secured to the nozzle ring with a guide portion of the axial-radial guide pin projecting axially from the first face of the nozzle ring. The guide portion of the axial-radial guide pin has an outer surface confronting the radially inner edge of the unison ring such that the unison ring is restrained by the axial-radial guide pin against excessive radial movement. Thus, the radial guide rollers and axial-radial guide pin cooperate to radially locate the unison ring in the proper location with respect to the nozzle ring.

The variable-vane assembly can further include at least one additional axial-radial guide pin restraining the unison ring against excessive radial movement.

In another embodiment of the variable-vane assembly, the radial guide rollers are all located on one side of an imaginary line that divides the unison ring into two half circles, and the axial-radial guide pin(s) is (are) located on an opposite side of the imaginary line. The axial stop is also located on said one side of the imaginary line.

The variable-vane assembly can also include a vane arm stop affixed to the nozzle ring and positioned both to function as a hard stop for one of the vane arms and to restrain the unison ring against excessive movement in a radial direction. The vane arm stop can comprise a pin having a portion received in an aperture in the nozzle ring and rigidly affixed therein.

In a further embodiment, the variable-vane assembly further comprises a main arm engaged with the unison ring, the main arm being pivotable so as to rotate the unison ring and thereby move the vane arms to pivot the vanes. There is also a main arm stop affixed to the nozzle ring and positioned both to function as a hard stop for the main arm and to restrain the unison ring against excessive movement in a radial direction. The main arm stop can comprise a pin having a portion received in an aperture in the nozzle ring and rigidly affixed therein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
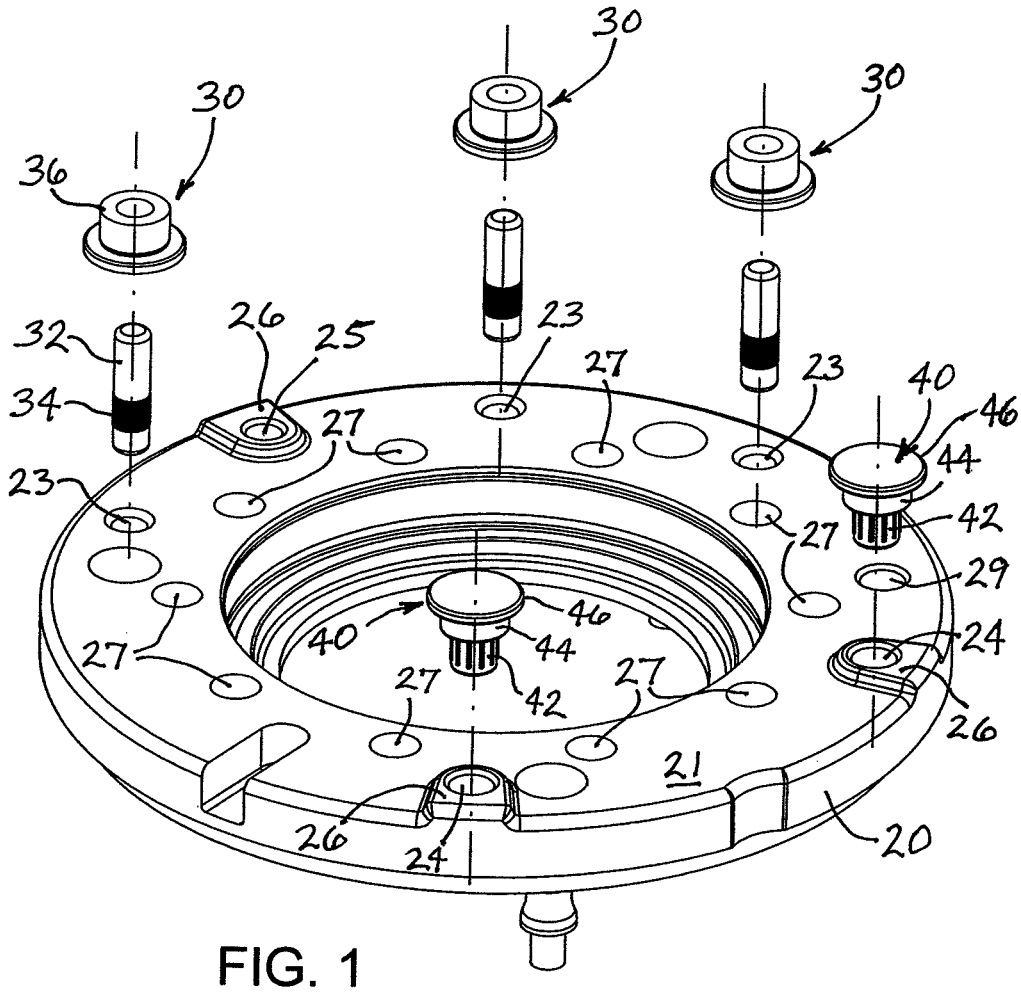
FIG. 1 is an exploded view of a nozzle ring assembly comprising a nozzle ring, radial guide rollers, and axial-radial guide pins, in accordance with one embodiment of the invention.
Figure 2:
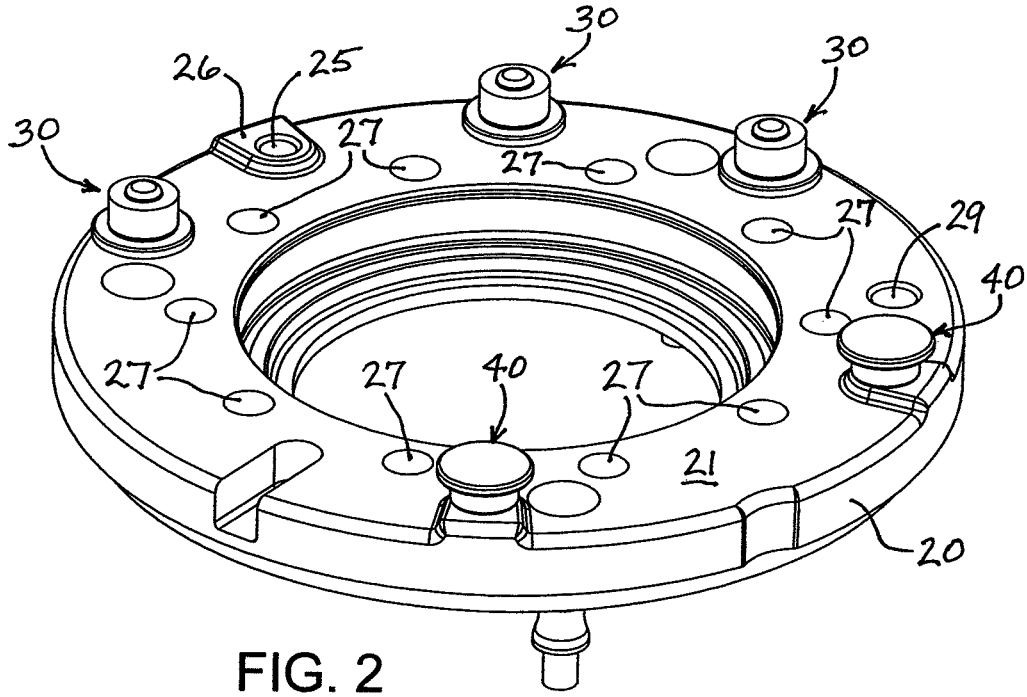
FIG. 2 is a perspective view of the nozzle ring assembly, showing the radial guide rollers and axial-radial guide pins fixedly secured in corresponding apertures in the first face of the nozzle ring.
Figure 7:
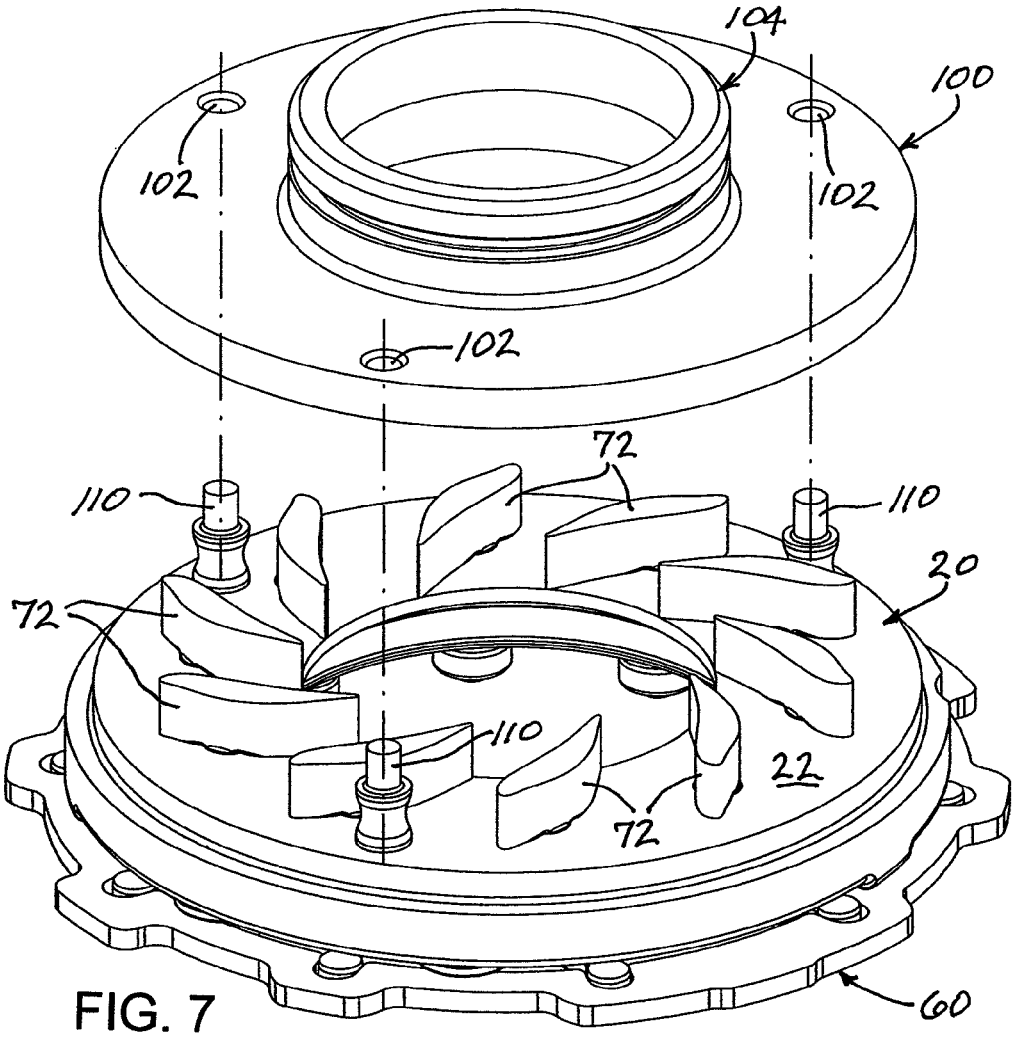
FIG. 7 is an exploded view of an assembly comprising the assembly of FIG. 6 and a nozzle insert.

FIGS. 1 and 2 depict (in exploded and assembled conditions, respectively) a partial assembly that makes up part of a variable vane assembly in accordance with one embodiment of the invention. The partial assembly comprises a nozzle ring 20, a plurality of radial guide rollers 30, and a plurality of axial-radial guide pins 40. The nozzle ring has a first face 21 and an opposite second face 22 (FIG. 7). Extending into the first face 21 are a plurality of spaced-apart apertures 23, 24, 25, 27, and 29. Only the apertures 27 extend all the way through the nozzle ring to the second face 22; the other apertures 23, 24, 25, and 29 are blind holes. The apertures 23, 24, 25, and 29 are also referred to herein as "first apertures" and the apertures 27 are referred to as "second apertures". Each of the apertures 24 and 25 is surrounded by a raised pad 26 defined by the nozzle ring. The pads 26 project beyond the remainder of the generally planar first face 21 of the nozzle ring.

Each of the radial guide rollers 30 comprises a pin 32 having a knurled section 34 and a roller 36. The pin 32 is inserted into a correspond one of the apertures 23 in the nozzle ring and is pressed into the aperture until the knurled section 34 is in engagement with the inner surface of the aperture. The roller 36 is made up of a stationary part that has a central hole that receives the end portion of the pin 32 with an interference fit, and a rotary part that can rotate on the stationary part.

Each of the axial-radial guide pins 40 includes a knurled section 42 that is inserted into a correspond one of the apertures 24 in the nozzle ring and is pressed into the aperture until the knurled section 42 is in engagement with the inner surface of the aperture. Each axial-radial guide pin further includes a radial guide section 44 and an axial guide section 46 (collectively, a "guide portion"). The radial guide section 44 comprises a generally cylindrical section of a first diameter and the axial guide section 46 comprises a cap having a second diameter greater than the first diameter.

Figure 3:
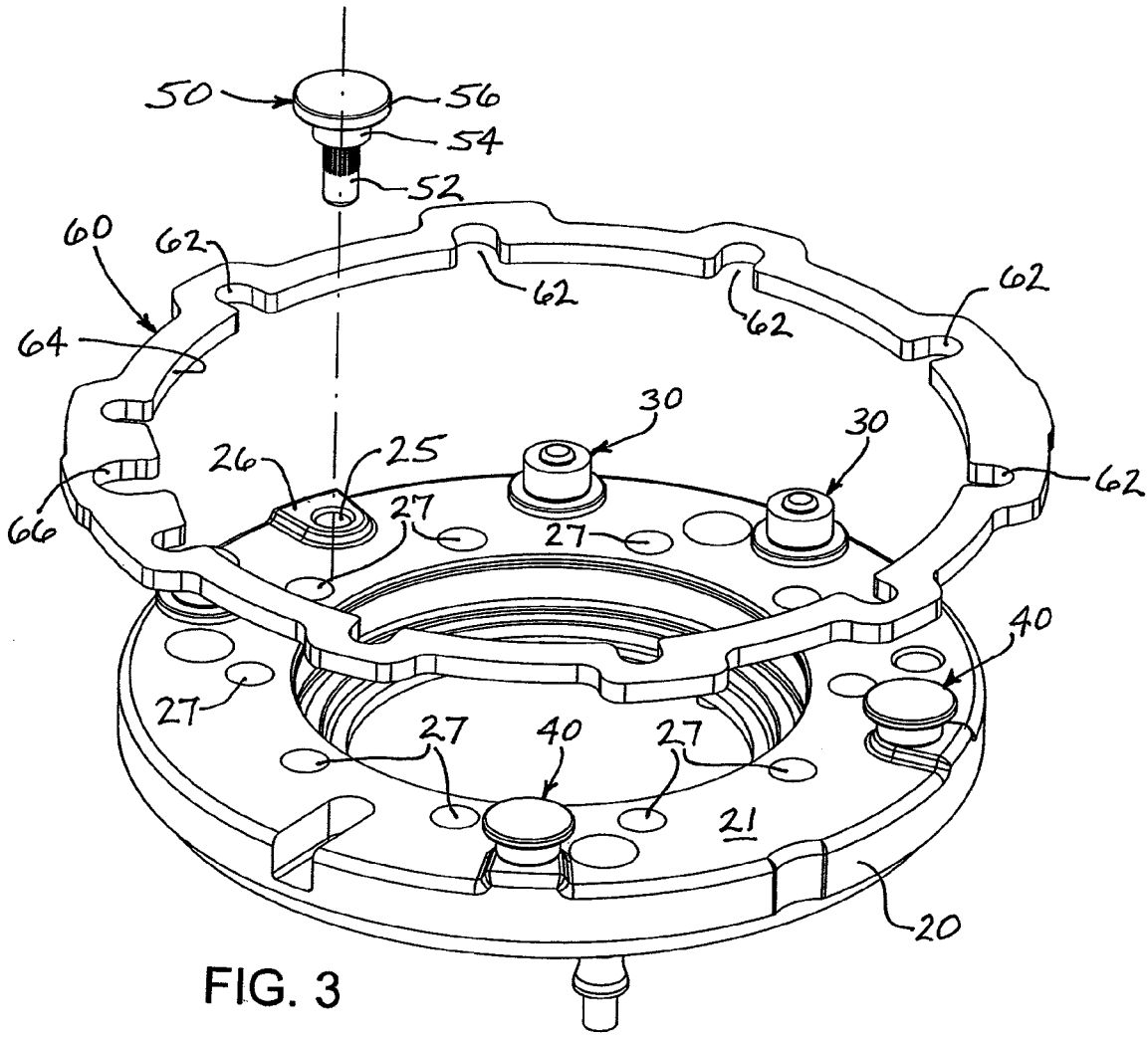
FIG. 3 is an exploded view of an assembly comprising the nozzle ring assembly of FIG. 2, a unison ring, and an axial stop.
Figure 4:
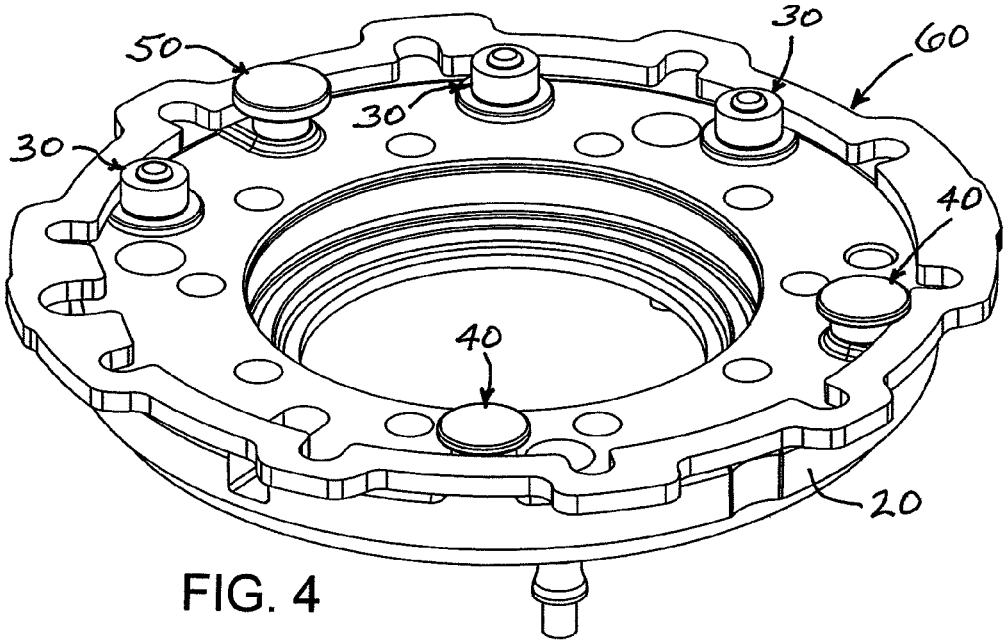
FIG. 4 is a perspective view of the assembly of FIG. 3.

FIGS. 3 and 4 depict (in exploded and assembled conditions, respectively) a partial assembly comprising the assembly of FIG. 2, an axial stop 50, and a unison ring 60. The unison ring defines a plurality of recesses 62 in its radially inner edge 64, for receiving the ends of vane arms as further described below. The diameter of the unison ring's radially inner edge 64 is slightly larger than a circle that is defined collectively by the radial guide sections 44 of the axial-radial guide pins 40 and by the rollers 36 of the guide rollers 30. The unison ring 60 is placed adjacent the first face 21 of the nozzle ring 20, in contact with the raised pads 26 on the nozzle ring. The axial stop 50 is then inserted into the aperture 25 in the nozzle ring. The axial stop 50 includes an affixing portion formed as a pin having a knurled section 52, a larger-diameter cylindrical section 54, and an even larger-diameter cap or stop portion 56. The pin portion is press-fit into the aperture 25 until the knurled section 52 is in engagement with the inner surface of the aperture. The cap or stop portion 56 of the axial stop is large enough in diameter that a portion of it overhangs the inner edge 64 of the unison ring 60 and serves to prevent excessive axial movement of the unison ring away from the nozzle ring. The radial guide section 44 of each of the axial-radial guide pins 40 defines a radial guide surface that confronts the radially inner edge of the unison ring 60. The axial-radial guide pins 40 thus collectively restrain the unison ring against excessive movement in radial directions. The axial guide section 46 of each of the axial-radial guide pins 40 overhangs the inner edge of the unison ring and defines an axial guide surface that prevents excessive axial movement of the unison ring away from the nozzle ring.

Figure 5:
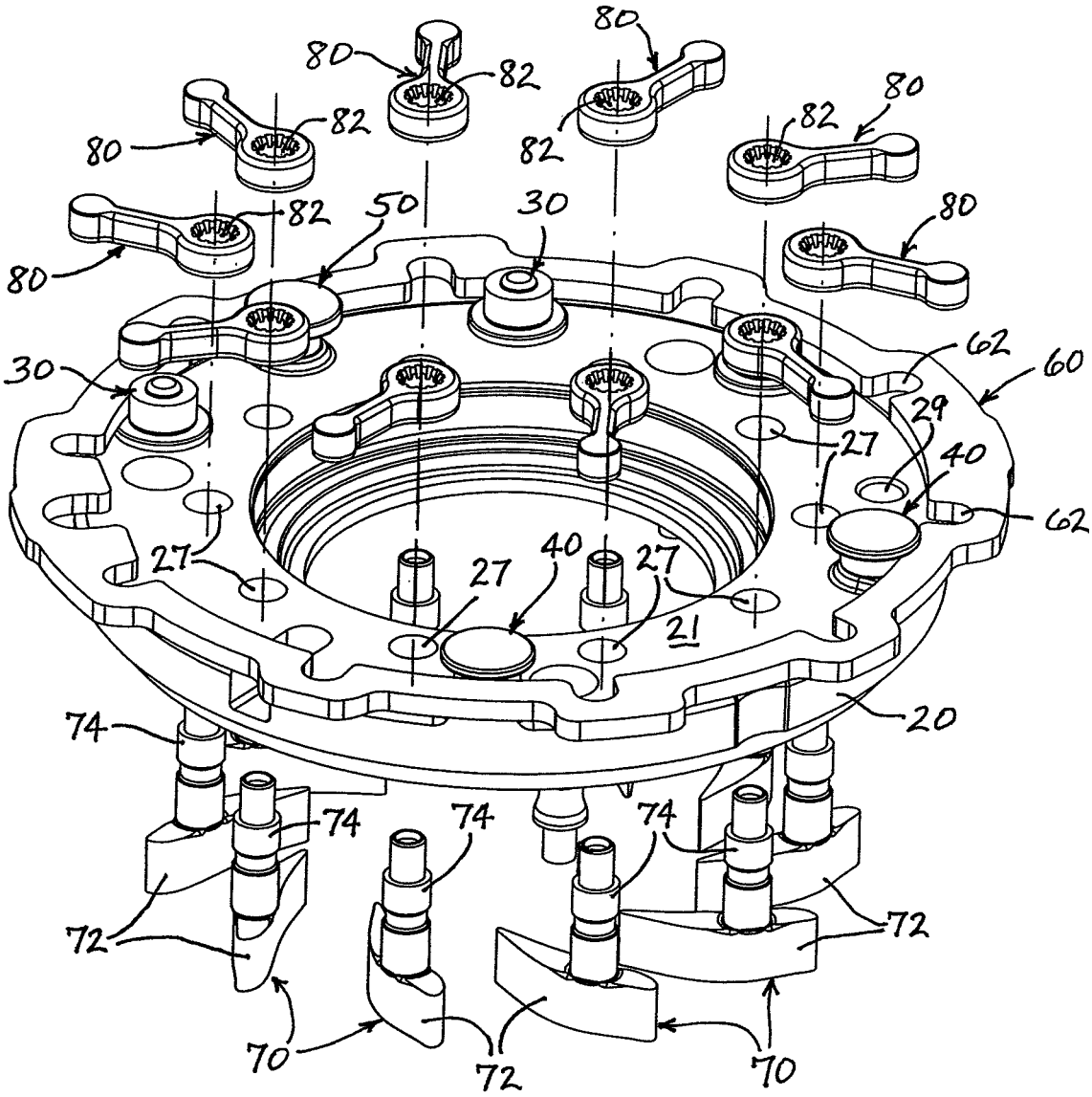
FIG. 5 is an exploded view of an assembly comprising the assembly of FIG. 4, a plurality of vanes with their attached vane axles, and a plurality of vane arms.
Figure 6:
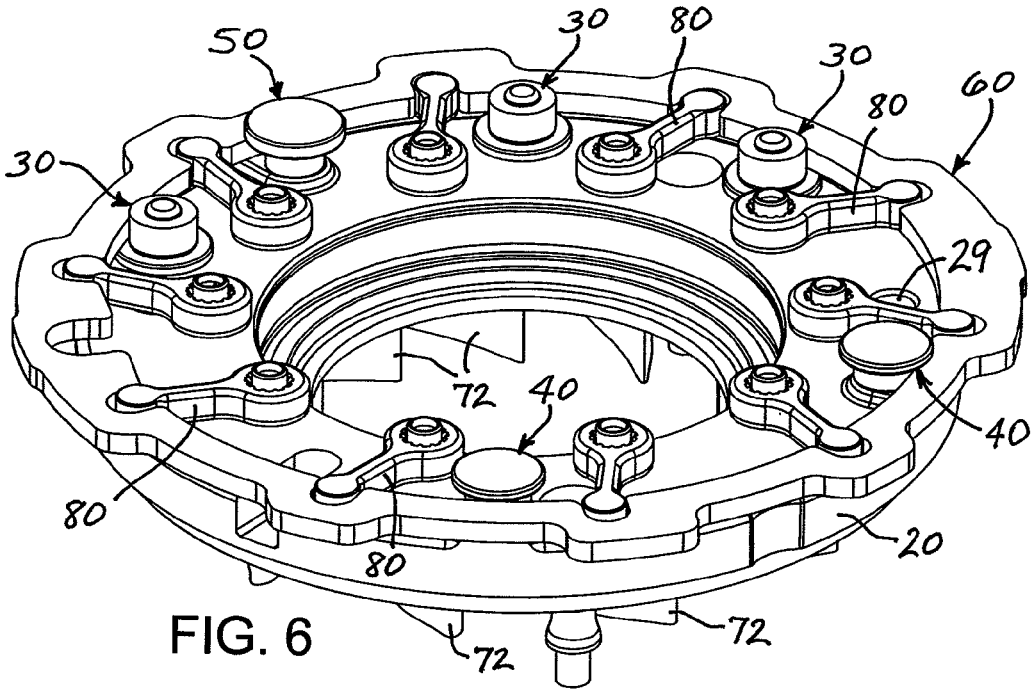
FIG. 6 is a perspective view of the assembly of FIG. 5.

FIGS. 5 and 6 depict (in exploded and assembled conditions, respectively) a further assembly comprising the assembly of FIG. 4 together with a plurality of vanes 70 and vane arms 80. Each vane 70 comprises an airfoil section 72 joined to an axle 74. The axles 74 are inserted through the apertures 27 in the nozzle ring until the airfoil sections 72 are abutting the second face of the nozzle ring. The ends of the axles 74 project beyond the first face 21 of the nozzle ring and are press-fit or otherwise rigidly secured within holes 82 defined in the radially inner ends of the vane arms 80. The radially outer ends of the vane arms 80 are received in the recesses 62 of the unison ring 60.

Rotation of the unison ring 60 in one direction or the other causes the vane arms 80 to pivot in one direction or the other, which in turn rotates the axles 74 to cause the airfoil sections 72 to pivot in one direction or the other.

Figure 8:
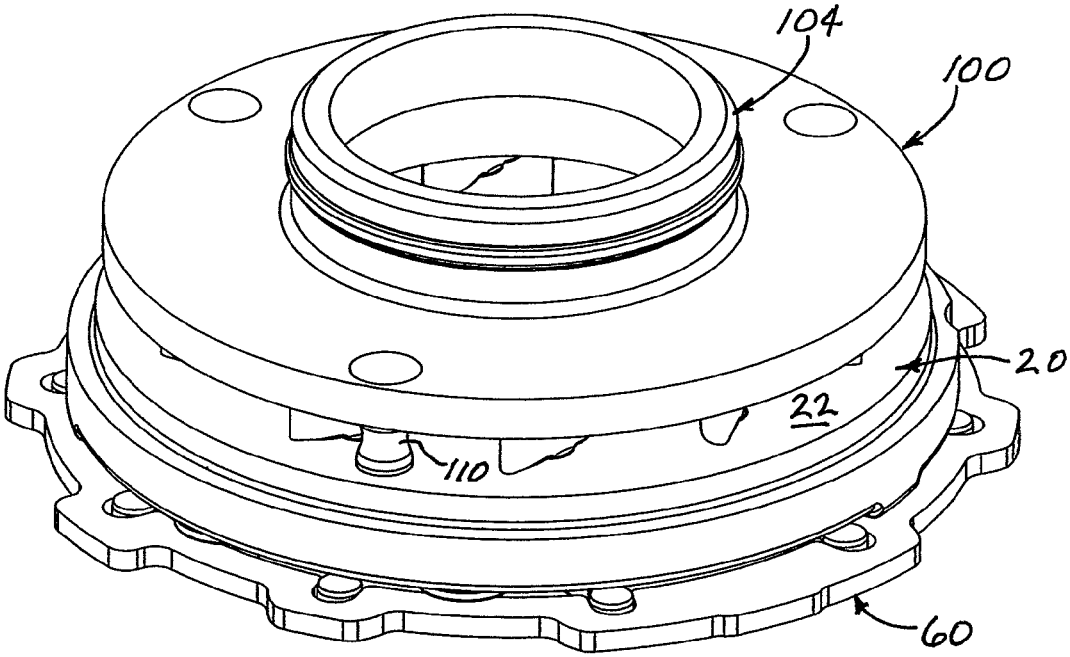
FIG. 8 is a perspective view of the assembly of FIG. 7.

FIGS. 7 and 8 depict (in exploded and assembled conditions, respectively) a further assembly comprising the assembly of FIG. 6 and a turbine housing insert 100. Three spacers 110 are rigidly affixed to the nozzle ring 20 and project axially from the second face 22 thereof for engagement with the turbine housing insert 100. The turbine housing insert 100 has three apertures 102 for receiving end portions of the spacers 110. The spacers have shoulders or radial bosses that abut the second face of the nozzle ring and the opposite face of the insert 100 so as to dictate the axial spacing between these faces. The spacers are rigidly affixed to the nozzle ring and insert, such as by welding. The nozzle ring and insert thus cooperate to form a passage therebetween, and the airfoil sections 72 of the vanes are arranged in the passage and preferably extend in the axial direction fully across the passage so that fluid flowing through the passage is constrained to flow through the spaces between the airfoil sections.

The turbine housing insert 100 is configured with a tubular portion 104 to be inserted into the bore of a turbine housing in a turbocharger. The entire variable-vane assembly, including the turbine housing insert 100, forms a unit that is installable into the turbine housing bore. The turbine housing is then connected to a center housing of the turbocharger such that the variable-vane assembly is captured between the turbine and center housings.

Figure 9:
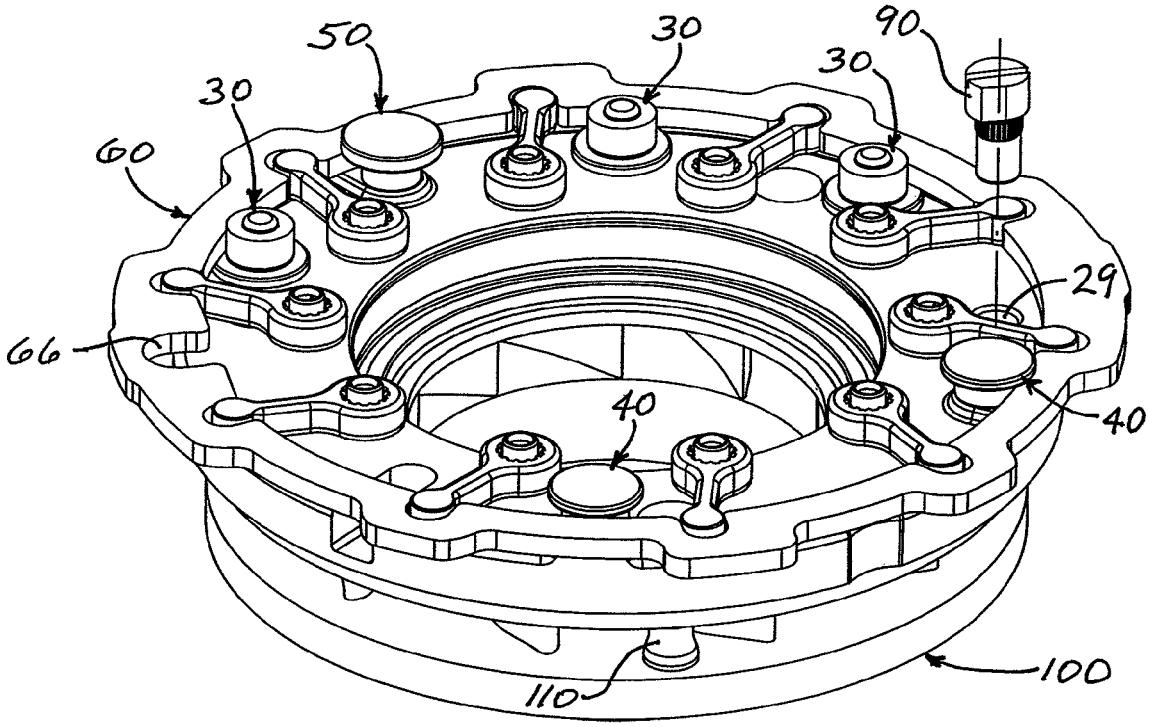
FIG. 9 is an exploded view of an assembly comprising the assembly of FIG. 8 and a vane arm stop.
Figure 10:
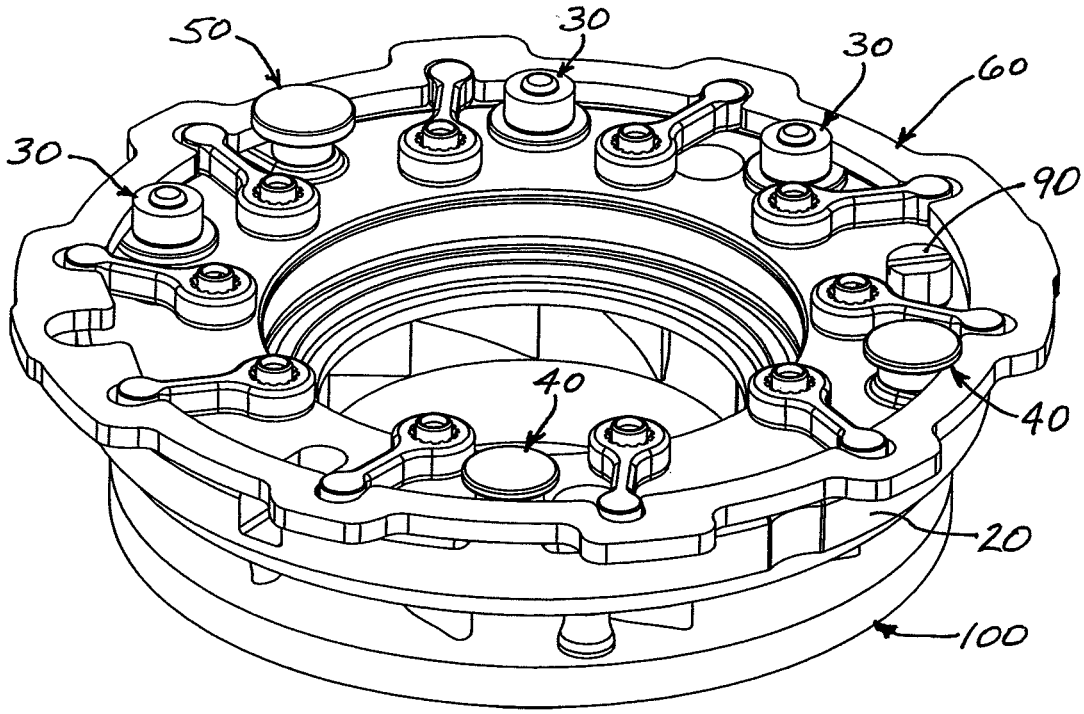
FIG. 10 is a perspective view of the assembly of FIG. 9.

FIGS. 9 and 10 depict (in exploded and assembled conditions, respectively) a complete variable-vane assembly in accordance with one embodiment of the invention. The variable-vane assembly comprises the assembly of FIG. 8 together with a minimum flow-setting pin 90 that is received in the aperture 29 in the nozzle ring 20 in such a manner that the flow-setting pin is rotatable in the aperture about its axis. The flow-setting pin 90 in the illustrated embodiment comprises a pin or the like, having a slotted head for receiving a screwdriver or similar tool. The flow-setting pin also includes an eccentric cam extending radially out from the shaft of the flow-setting pin. The flow-setting pin is positioned such that the cam can contact one of the vane arms 80, and such that rotation of the flow-setting pin in one direction about its axis causes the cam to push the vane arm and cause it to rotate about the pivot axis defined by the vane axle 74 attached to the vane arm. This rotation of the vane arm causes the unison ring 60 to be rotated, which in turn causes the other vane arms 80 to rotate in unison with the vane arm in contact with the pin 90. In this manner, all of the vanes are pivoted in unison when the flow-setting pin is rotated.

An operator can use the flow-setting pin 90 during a calibration procedure for the variable-vane assembly. With the variable-vane assembly installed in a suitable test fixture that supplies a fluid through the nozzle defined by the assembly, the operator turns the flow-setting pin while monitoring the flow rate of the fluid, which can be measured by a suitable flow meter associated with the fluid source. The flow-setting pin is turned until the indicated flow rate reaches a predetermined level (e.g., a minimum flow rate, or alternatively a specified quantitative flow rate). The flow-setting pin 90 is then permanently fixed in the position determined during the calibration process, such as by welding the flow-setting pin to the nozzle ring 20 or by press-fitting the flow-setting pin (while preventing it from rotating) further into the aperture 29 such that the flow-setting pin is immobilized by frictional interference fit.

In accordance with some embodiments of the invention, the radial guide rollers 30 are all located to one side of an imaginary line or diameter that divides the nozzle ring 20 into two half-circular ring halves. Stated differently, the radial guide rollers 30 are confined to a circumferentially extending region of the nozzle ring that subtends an arc of less than 180°. The axial-radial guide pins 40 are located on an opposite side of the imaginary line.

The three radial guide rollers 30 are one side of the imaginary line because of kinematics caused by the force exerted on the unison ring by the main arm (not shown), which engages the recess 66 in the unison ring. Thus, when looking down on the variable-vane assembly shown in FIG. 9 (in which exhaust enters in a clockwise direction), and defining the zero-degree position as the location of the recess 66 for the main arm, the rollers 30 are located between about 10° and about 150° clockwise around the nozzle ring. The rollers are located in this region because the exhaust gas biases the vanes toward the open position, which biases the unison ring 60 to turn clockwise, which in turn requires the main arm to impart an opposing counter-clockwise force on the unison ring in a tangential direction generally opposite the rollers 30. Thus, the rollers 30 prevent the unison ring from being moved off-center, and carry the bulk of the reaction force on the unison ring.

The axial stop 50 provides restraint of the unison ring 60 in the axial direction but not in the radial direction. Accordingly, the axial stop 50 can be located in the same general area as the rollers 30, since radial guidance of the unison ring is already being accomplished in that area by the rollers. Thus, the axial stop 50 can be located on the same side of the aforementioned imaginary line as the rollers 30.

The axial-radial guide pins 40 provide radial guidance of the unison ring, particularly when the main arm rotates the unison ring clockwise to open the vanes, which would tend to move the unison ring away from the guide rollers 30. As noted above, the exhaust gas tends to urge the vanes toward the opening direction, and thus the force required to rotate the unison ring in the opening direction is less than the force required to move it in the closing direction. The fixed axial-radial guide pins 40 thus are adequate for radially guiding the unison ring in these conditions, where the radial forces exerted on the guide pins are relatively small and hence frictional forces are not excessive, compared to the radial forces exerted on the guide rollers 30 when the vanes are being closed, where the frictional forces on fixed guides would be undesirably high.

A further aspect of some embodiments of the invention is the use of a combined radial guide and arm stop, i.e., a pin or the like that serves both as a radial guide for the unison ring 60 and as a stop for either a vane arm 80 or the main arm (not shown). With reference to FIG. 10, instead of including the pin 90, the variable-vane assembly can include a differently configured pin that serves not only to limit pivoting of the adjacent vane arm 80 in a manner similar to the pin 90, but also to radially guide the unison ring 60.

Many modifications and other embodiments of the inventions set forth herein will come to mind to one skilled in the art to which these inventions pertain having the benefit of the teachings presented in the foregoing descriptions and the associated drawings. For example, while the illustrated embodiments include a plurality of fixed axial-radial guide pins 40, other embodiments may employ only one such axial-radial guide pin, or may not include any axial-radial guide pins at all. In the latter case, the unison ring would be guided by the radial guide rollers 30 and the axial stop 50 or more than one such axial stop. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A variable-vane assembly for a turbocharger, comprising:

a nozzle ring encircling an axis and having an axial thickness defined between opposite first and second faces of the nozzle ring, the nozzle ring having a plurality of circumferentially spaced-apart first apertures each extending axially into the first face and a plurality of circumferentially spaced-apart second apertures that are circumferentially spaced from the first apertures and each of which extends axially from the first face to the second face;

a plurality of vanes each having an axle extending from one end thereof, the axles being received respectively into the second apertures from the second face of the nozzle ring and being rotatable in the second apertures such that the vanes are rotatable about respective axes defined by the axles, a distal end of each axle projecting out from the respective second aperture beyond the first face;

a plurality of vane arms respectively affixed rigidly to the distal ends of the axles, each vane arm having a free end;

a unison ring positioned coaxially with the nozzle ring adjacent the first face thereof, the unison ring having a first side that faces the first face of the nozzle ring and having an opposite second side, the unison ring having a radially inner edge defining a plurality of recesses therein respectively receiving the free ends of the vane arms, the unison ring being rotatable about the axis of the nozzle ring so as to pivot the vane arms, thereby pivoting the vanes in unison;

a plurality of radial guide rollers for the unison ring, the radial guide rollers each being supported on a pin that is received in a respective one of the first apertures in the nozzle ring and is rigidly affixed therein such that the radial guide rollers are secured to the nozzle ring and positioned such that the radially inner edge of the unison ring is restrained by the radial guide rollers against excessive movement in radial directions;

a fixed axial stop for the unison ring, the axial stop having an affixing portion that is received in another of the first apertures in the nozzle ring and is rigidly affixed therein, and a stop portion projecting out from the first aperture, a part of the stop portion overhanging and opposing the second side of the unison ring so as to prevent excessive axial movement of the unison ring away from the nozzle ring, the axial stop providing restraint of the unison ring in the axial direction but not in the radial direction; and a plurality of axial-radial guide pins respectively inserted into first apertures of the nozzle ring circumferentially spaced apart about the nozzle ring and rigidly affixed therein such that each of the axial-radial guide pins is non-rotatably secured to the nozzle ring with a guide portion of the axial-radial guide pin projecting axially from the first face of the nozzle ring, the guide portion of each axial-radial guide pin having a radial guide surface confronting the radially inner edge of the unison ring and an axial guide surface confronting the second side of the unison ring, such that the unison ring is restrained by the axial-radial guide pins against excessive radial and axial movements, wherein the radial guide rollers are all located on one side of an imaginary line that divides the nozzle ring into two half-circular ring halves, and the axial-radial guide pins are located on an opposite side of the imaginary line, and wherein the axial stop is located on said one side of the imaginary line.

2. The variable-vane assembly of claim 1, further comprising a vane arm stop affixed to the nozzle ring and positioned both to function as a hard stop for one of the vane arms and to restrain the unison ring against excessive movement in a radial direction.

* * * * *